US005311704A

United States Patent [19]

Barton II et al.

[11] Patent Number: 5,311,704

[45] Date of Patent: May 17, 1994

[54] METHOD AND APPARATUS FOR CORRECTING DIAMETRICAL TAPER ON A WORKPIECE

[76] Inventors: Kenneth A. Barton II, 1413 Airway Dr., Waterford, Mich. 48327; Rolf O. Bochsler, 288 Dino Dr., Ann Arbor, Mich. 48103

[21] Appl. No.: 886,682

[22] Filed: May 20, 1992

[51] Int. Cl.[5] ..... B24B 49/00

[52] U.S. Cl. ..... 51/165.76; 51/165.74; 51/165.91; 51/161; 51/289 R

[58] Field of Search ..... 51/165.72, 165.74, 165.75, 51/165.76, 165.77, 165.83, 165.85, 165.88, 165.90, 165.91, 161, 204, 289 R

[56] References Cited

U.S. PATENT DOCUMENTS

| | | | |
|---|---|---|---|
| R. 28,082 | 7/1974 | Price | 51/165 R |
| 3,271,910 | 9/1966 | Haisch | 51/165 R |
| 5,095,663 | 3/1992 | Judge et al. | 51/165.91 |
| 5,148,636 | 9/1992 | Judge et al. | 51/165.91 |

*Primary Examiner*—Bruce M. Kisliuk

*Assistant Examiner*—E. Morgan

*Attorney, Agent, or Firm*—Brooks & Kushman

[57] ABSTRACT

A microfinishing arm assembly for reducing taper on selected bearing journal surfaces of various workpieces rotated about a longitudinal axis. The microfinishing arm assembly includes a primary finishing arm and a taper correction means for applying a plurality of adjacent independently variable grinding pressures. A primary abrasive means for finishing a journal surface is mountable on the primary finishing arm and adapted for use in cooperation with the taper correction means. A measuring means for gauging the bearing journal surfaces at a plurality of spaced points during rotation is utilized with a processor means for receiving the gauging signals, calculating diameters of the journal surfaces and generating a plurality of output signals corresponding to the diameters of the bearing surfaces at spaced points. A comparator means compares the output signals to determine whether a taper exists on selected journal surfaces and controls the extent to which a taper correction means applies variable grinding pressure to the surfaces to correct the taper.

27 Claims, 2 Drawing Sheets

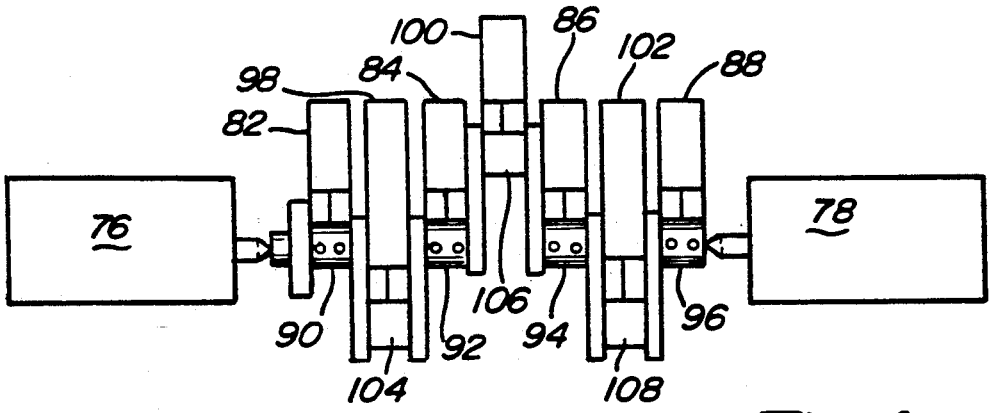
Fig-4
Fig-2
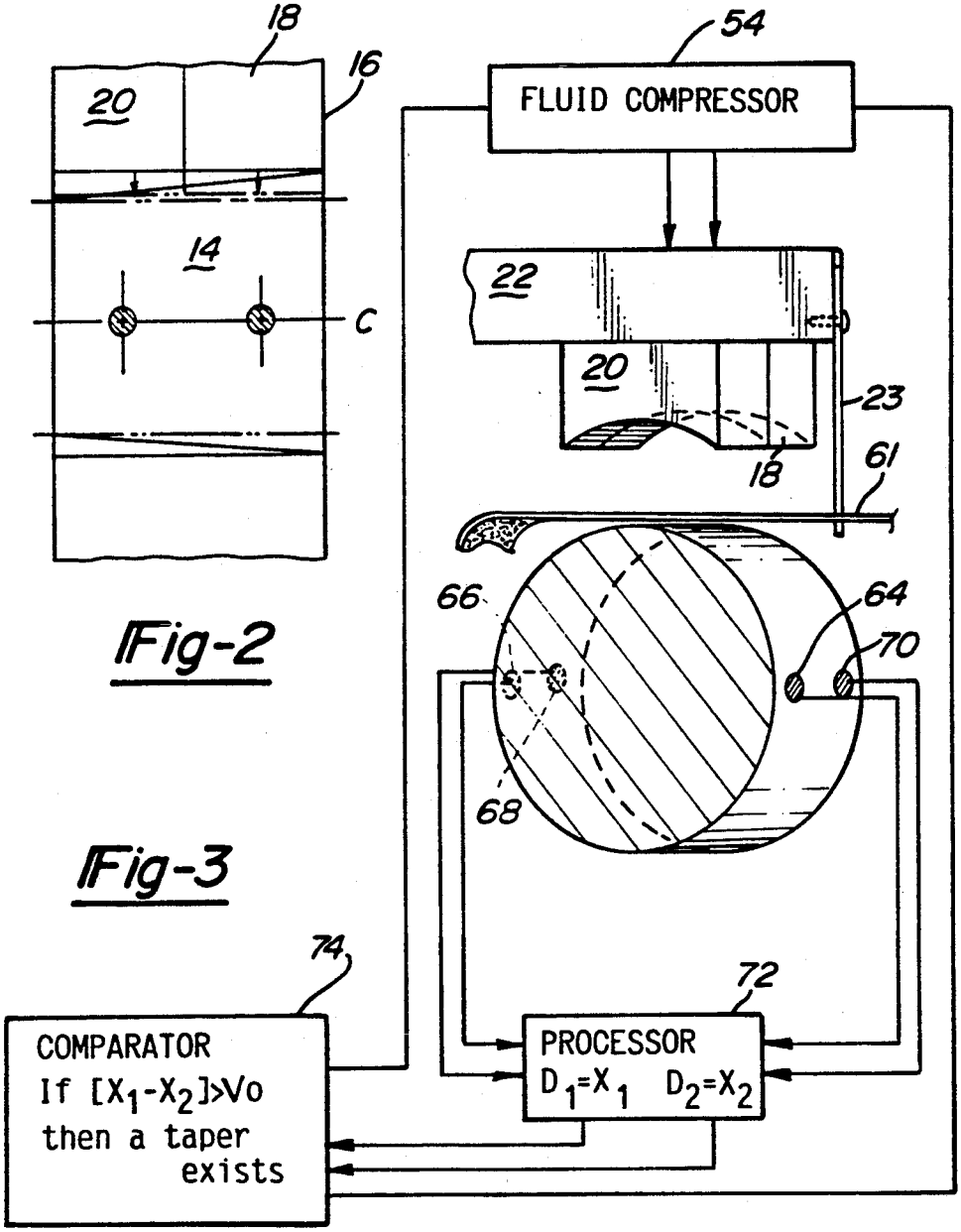
Fig-3

METHOD AND APPARATUS FOR CORRECTING DIAMETRICAL TAPER ON A WORKPIECE

TECHNICAL FIELD

This invention relates generally to a diametrical taper correction system, and specifically to a machine and machine arm assembly utilizing in-process gauging to correct diametrical taper on a workpiece journal surface.

BACKGROUND ART

This invention relates to a method and apparatus for correcting diametrical taper formed on workpiece journal surfaces, which were previously ground in a large scale manufacturing grinding machine. Taper, as known in the art, is a condition in which the diameter of a bearing surface is not constant along the axial length of the surface. This condition occurs when grinding machines used to grind the workpieces are improperly maintained or when the various abrading means used to remove material from the workpiece are inadequately dressed during operation.

The prior art contains various examples of grinding processes and machines that utilize an in-process gauging system for altering or inducing modifications in a grinding process to correct taper. As it is known in the art, in-process gauging is a method of controlling a grinding or finishing operation in a machine wherein engagement of the grinding or abrading means with the workpiece is controlled in real-time by a measurement signal generated from a gauge that is likewise in contact with the workpiece surface. The grinding process can then be varied and different results achieved by modifying various controls within the grinding process in relation to the gauging signals.

Prior to this invention, in-process gauging was used to correct taper existing on a plurality of diameters on a workpiece by altering the grinding angle of the grinding wheel in relation to the workpiece during the grinding process. An example of this method is disclosed in U.S. Reissue Pat. No. 28,082 to Price, reissued Jul. 23, 1974. The Price patent discloses a multiple or wide wheel grinding machine with a means provided to vary the relative grinding angle between the surfaces of a workpiece to be ground and the grinding wheel.

In the grinding machine of the Price patent, a pair of electrical size gauges are disposed alongside the workpiece on separate axially spaced bearing surfaces. These size gauges generate electrical signals as the workpiece is being rotated about its longitudinal axis during the grinding cycle. The two signals are compared directly and a third signal is generated when the difference between the signals exceeds a predetermined value. The third signal actuates a means for deflecting the grinding wheel and varying the angle of the grinding contact point in response to the third signal, correcting the taper previously existing on the part while it is in the overall grinding process.

U.S. Pat. No. 3,271,910 to Aisch discloses a method for correcting the size and angular relation between a workpiece to be ground and the grinding wheel. Again, two size gauges are axially spaced f rom each other on two different bearing surfaces of a workpiece such as a automotive crankshaft. The two gauge signals measure the diameters at the extreme ends of the workpiece. When differences are noted in the measured diameters and an independent master diameter, a servo motor is engaged to displace the tail stock, thereby changing the angle that the grinding wheel contacts the workpiece surfaces being ground. This displacement continues until deviations from the master diameter are compensated for (i.e. until there is no longer differences between the diameters measured and the master diameter).

As energy efficiency and fuel consumption considerations become more and more important to automotive manufacturers, bearing journal surfaces on internal combustion engine components and related machine components will continue to be machined to closer and closer tolerances. Increased bearing loads, higher operating speeds and greater durability requirements in today's internal combustion engine manufacturers also further the need for precision finishing of journal bearing surfaces. Included with the requirement for more precision finishing is the need to reduce diametrical taper existing on bearing surfaces. As disclosed in the prior art patents above, taper correction was generally utilized as part of the ongoing grinding process and not as an independent operation used to generate higher quality parts.

Prior art methods utilized a modification in angular relation between the longitudinal axis of the workpiece being ground and the longitudinal axis of the grinding tool or wheel. Taper conditions were measured by taking individual diameter readings from two different bearing surfaces spaced axially apart. As disclosed in the prior art patents, the gauge points were generally spaced apart as far as possible by placing one gauge point on the bearing surface closest to one end of the workpiece and one gauge point on the bearing surface closest to the opposite end of the workpiece.

The relative positioning of these gauges is useful in determining whether there is a difference in diameter between the two surfaces being gauged but fails to measure any of the bearing surface configurations spaced axially between the two gauged surfaces on the workpiece. As is known in the art, there are numerous variables in the grinding process such as grinding means dress intervals, grinding means dress quality and the overall general maintenance of the grinding machine. Thus, utilizing in-process gauging to determine the diameters of the bearing surfaces at two axially spaced positions does not give an accurate indication of the diametrical taper conditions that may exist on bearing surfaces spaced between the two engaging positions.

In process gauging in combination with microfinishing operations is disclosed in U.S. Pat. No. 5,095,663 to Judge et al. The Judge et al patent discloses a microfinishing device using in process gauging to measure the diameter of an internal bearing system during the microfinishing process. The microfinishing process is terminated once a predetermined diameter is achieved on the part. The Judge et al patent discloses the use of size control shoes which monitor the diameter of the journal surface using stationary probes in conjunction with air gauges.

The Judge et al patent further discloses the use of an abrasive backed tape to remove material upon the journal surface upon rotation of the workpiece. A microfinishing shoe is used for pressing the abrasive coated film against a portion of a circumference of a journal surface. The microfinishing shoe disclosed is configured as a one-piece, solid, construction capable of applying only grinding forces transferred from the scissor type action of the grinding arm the shoe is affixed to.

SUMMARY OF THE INVENTION

In accordance with the present invention, a taper correcting microfinishing arm assembly is provided for reducing taper on selected journal surfaces of a workpiece. The assembly includes a means for applying a variable abrading pressure to a selected journal surface at predetermined locations. At least two diameter gauges are disposed along the surface during rotation of a workpiece and generate gauging signals representing the diameter of the surface at two axially spaced locations along the surface. A means for comparing the gauging signals and generating a control signal for applying a variable abrading pressure to correct the taper is included.

It is an object of the present invention to provide a taper correcting microfinishing arm assembly for reducing taper on selected journal bearing surfaces of a workpiece.

Another object of the present invention is to provide a taper correcting microfinishing arm that reduces taper on selected journal bearing surfaces of a workpiece by utilizing in-process gauging at selected bearing surfaces to be finished along the axial length of a workpiece.

It is another object of the present invention to provide a means for reducing taper automatically without losing contact between the grinding means on the surface of a workpiece and the bearing journal surface.

It is a further object of the present invention to utilize at least two diameter gauge points per bearing surface to be finished in the in-process gauging apparatus for arriving at a more accurate determination of the diametrical taper existing on the workpiece.

It is a still further object of the present invention to provide a means for comparing the diameters found on the bearing surface of the workpiece and controlling a means for applying a variable pressure to the bearing surface to reduce the defined diametrical taper.

It is yet another object of the present invention to provide a means for applying a variable pressure to the bearing surface contained on the workpiece with at least two independently variable back-up shoes which are utilized to reduce taper defined on the workpiece.

A more specific object of the present invention is to provide a taper correcting microfinishing for reducing taper on a selected rotatable bearing journal surface of a workpiece including a means for rotating the surface of the workpiece past a predetermined location and a means for applying a variable abrading pressure to the selected bearing journal surface at that predetermined location. The microfinishing machine includes a means for gauging the selected surface at space points during rotation generating gauging signals that represent a diameter of the selected bearing journal surface and a means for comparing the gauging signals to generate a controlling signal for applying variable pressure to correct taper.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIG. 2 is a partial front view of the present invention showing the variable grinding apparatus and a workpiece with an exaggerated taper and including the location of gauging points;

FIG. 3 is a schematic view of the general control system for the present invention; and FIG. 4 is a side view of a plurality of microfinishing arm assemblies according to the present invention shown in use with a crankshaft.

BEST MODE FOR CARRYING OUT THE INVENTION

Figure 1:
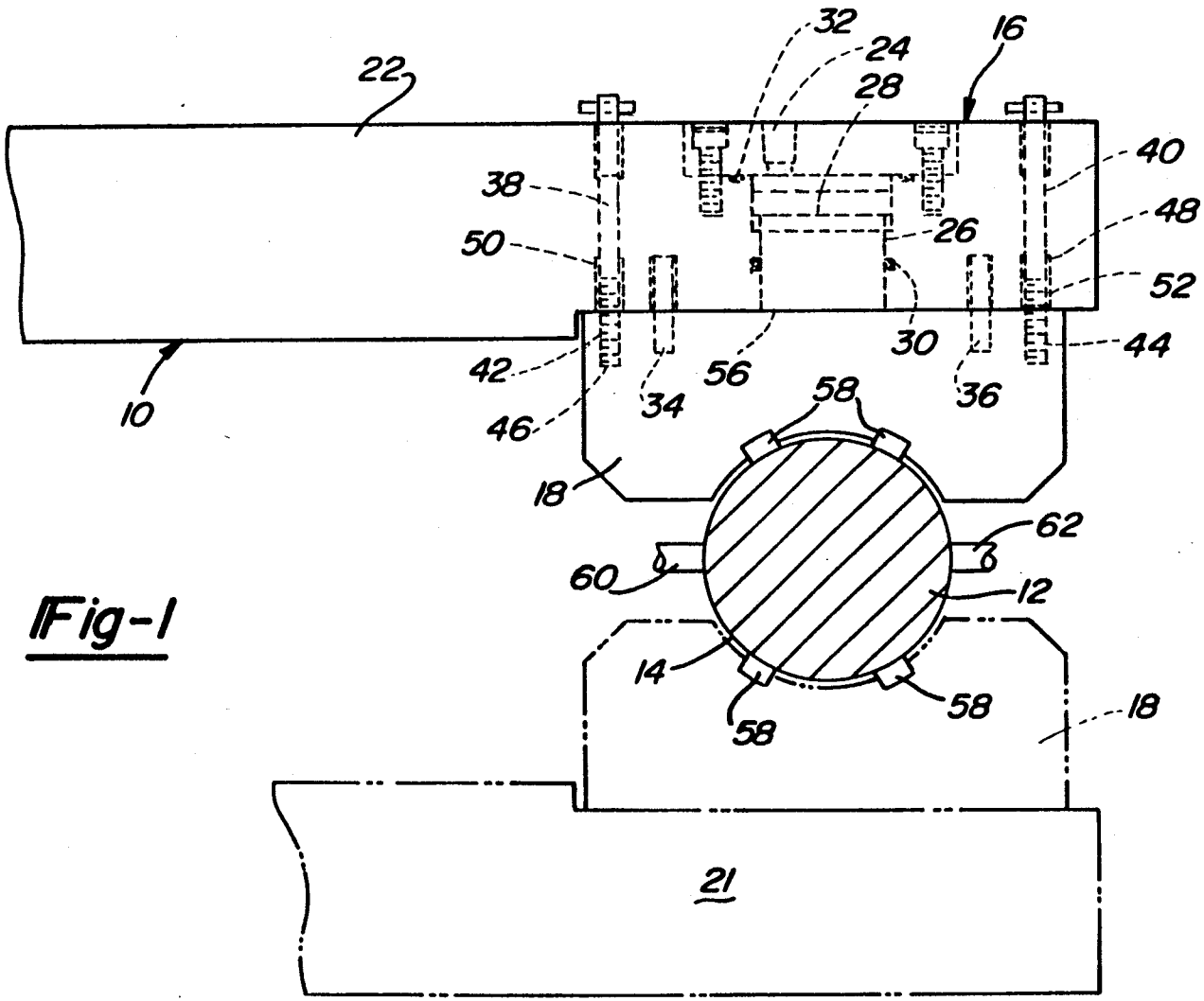
FIG. 1 is a side view of the taper correcting microfinishing arm assembly of the present invention showing a journal diameter in cross-section.

Referring now to FIG. 1 a microfinishing arm assembly in accordance with a first embodiment of the present invention is shown and generally designated by reference numeral 10. Microfinishing arm assembly 10 is shown in use adjacent a crankshaft 12 having a bearing journal surface 14 which requires taper correction. Taper correction fixture 16 is attached to microfinishing arm assembly 10 and is disposed directly adjacent bearing journal surface 14.

FIG. 2 shows an enlarged view of a bearing journal surface 14 in contact with taper correction fixture 16 and a greatly exaggerated depiction of diametrical taper existing on the bearing journal surface. Actual diametrical taper from the high side to the low side existing on various workpieces range anywhere from 1 (one) to 2 (two) thousandths of an inch. As discussed previously, this diametrical taper is generally induced in the prior grinding processes due to numerous variables including improperly dressed grinding materials, improperly maintained grinding machines, and material variations in different grinding processes.

Details of the mechanical components of the microfinishing arm assembly of the present invention are best described with reference to FIGS. 1 and 3. Microfinishing back-up shoes 18 and 20 are disposed immediately adjacent each other and mounted upon first finishing arm 22. It should be understood that back-up shoe 20 is identical to back-up shoe 18 and both operate in an identical manner with identical mechanical components. Backup shoe 20 is not shown in FIG. 1. Backup shoe 18 is affixed to first finishing arm 22 by mounting members 38 and 40. Mounting members 38 and 40 have threaded portions 42 and 44 which fit into tapped mounting holes 46 and 48 within backup shoe 18.

Mounting members 38 and 40 are also positioned within finishing arm mounting holes 50 and 52. Positioning dowels 34 and 36 are permanently affixed to backup shoe 18 and are positioned in slip fit engagement to corresponding dowel pin holes within first finishing arm 22 as shown in FIG. 1. In this arrangement, backup shoe 18 is affixed to first finishing arm 22 and is capable of vertical movement subject to pre-established limits corresponding to mounting members 38 and 40.

First finishing arm 22 has an elongated bore 6 and a corresponding reciprocating piston 28. Elongated bore 26 can be configured in various shapes and sizes depending upon the fluid compressor means utilized. Reciprocating piston 28 is positioned inside elongated bore 26 and backup shoe engaging portion 56 is in direct contact with first backup shoe 18. O-rings 30 and 32 are disposed as shown in FIG. 1 for bore sealing purposes. Fluid inlet 24 is in direct fluid communication with cylinder bore 26. FIG. 1 shows abrasive inserts 58 used as an abrasive means for removing material from the bearing journal surface 14. Abrasive inserts 58 are affixed within backup shoe 18 such that compressive contact of the abrasive inserts 58 with rotating bearing surface 14 removes material from bear surface 14. Finishing arm 22, backup shoes 18 and 20, reciprocating piston 28, fluid inlet 24 and the other mechanical components used to move backup shoes 18 and 20 vertically comprise taper correction fixture 16. A second finishing arm 22 is shown in phantom in FIG. 1 located below and opposite first finishing arm 22. Second finishing arm 21 includes an abrasive means (i.e. abrasive insert or abrasive coated tape) for finishing bearing surface 14 as discussed previously with respect to the abrasive means of finishing arm 22. The second finishing arm 22. The second finishing arm 21 is not necessary for the preferred embodiment of the present invention but may be utilized to aid in removing material from bearing surface 14.

Electromechanical gauges 60 and 62 are partially shown and disposed diametrically opposite each other on bearing journal surface 14. A second set of electromechanical gauges are not shown but are spaced axially apart from the first set of electromechanical gauges. All four electromechanical gauges lie in a plane parallel to the central axis of rotation of said workpiece.

FIG. 3 is a schematic representation of the principle features and method of using the present invention. Bearing journal surface 14 is rotated about a longitudinal axis "C" while a first set of gauge points 64 and 66 are disposed diametrically opposite each other adjacent the bearing journal surface 14. A second set of gauge points 68 and 70 are disposed diametrically opposite each other along bearing journal surface 14 and are also spaced apart and adjacent the first set of gauge points.

It is understood that these gauge points represent either electromechanical gauges, optical gauges, or air jet gauges. The type of gauge chosen will depend upon the number of workpieces the manufacturer intends to pass through the machine and the maintenance schedule the manufacturer intends to apply to the machine. It is known in the art that air jet gauges possess characteristics more conducive to heavy finishing or grinding operations because they require fewer cleaning intervals than other gauges. This characteristic is inherent in air gauges because of the constant flux of clean air which the gauge utilizes in operation. It is understood that electromechanical gauges and optical gauges can also be utilized in this invention depending upon the various uses the assembly is subject to.

Any gauge chosen must be capable of detecting changes in size of at least 0.00005 inches. Gauges located at gauge points 64, 66, 68 and 70 comprise a measuring means for gauging the bearing journal surface at spaced points upon the surface. These gauges generate a plurality of gauging signals which are transferred to a processor for calculating the diameters according to the gauging signals. This processor or means for calculating diameter is designated as reference numeral 72 in FIG. 3. Commercial processors are available to process the gauging signals to generate signals representing a diameter of the bearing journal surface at two planes on the bearing journal surface shown in FIG. 3 as diameters $D_1$ and $D_2$. The processor then transfers these signals representing diameters to a comparator 74. The output diameter signals are compared and used to establish whether a diametrical taper exists between the two diameter locations.

Comparator 74 is programmed with instructions for determining if a taper exists on the journal surface as shown in FIG. 3. Output signals received from the processor represent diameters $D_1$ and $D_2$. If the difference between $D_1$ and $D_2$ reaches a predetermined value $V_o$, a correctable taper is determined to be present on the part and the comparator sends a signal to the taper correction fixture for reducing taper. Predetermined constant $V_o$ is determined by the user and programmable into the comparator. This predetermined constant can be as low as 0.0002 of an inch.

Processing apparatus for comparing the diameters is commercially available and known in the prior art as a programmable controller system capable of producing a series of control signals. The comparator sends control signals to a taper correction means that applies a variable pressure to a fluid compressor 54. The backup shoes 18 and 20 are aligned above and adjacent the bearing journal surface 14. The control of the reciprocating piston thus controls the finishing pressure applied to the backup shoes. The pressure applied to the backup shoes is in turn transferred to the abrasive means located between the backup shoes and the bearing journal surface.

The backup shoes 18 and 20 are identical and have surface configurations corresponding to the shape of the bearing journal surface. The fluid compressor reacts correspondingly to signals sent by the comparator and can apply pressures as small as 10 (ten) pounds to the backup shoes.

Fluid compressor 54, not shown in FIG. 1, induces fluid either air or liquid, into elongated bore 26 through fluid inlet 24. Thus, the variable pressure that can be induced by the fluid compressor reciprocates piston 28 vertically inside cylinder 26. Piston 28 has an engaging portion 56 which is located directly above backup shoe 18 as shown in FIG. 1.

As pressure is applied from the fluid compressor through the bore and to backup shoe 18, backup shoe 18 comes in contact with an abrading means for removing material on the bearing journal surface. This abrading means can be an abrasive coated tape 60 as shown in FIG. 3 or a hard abrasive insert 58 as shown in FIG. 1. Referring to FIG. 3, the conventional abrasive coated tape is disposed between shoes 18 and 20 and bearing surface 14. As those skilled in the art will recognize, any conventional abrasive coated tape feed device may be affixed to fixture 16 to feed abrasive tape between the shoes 18 and 20 and the bearing surface 14. Hard abrasive inserts can be found in various compositions such as diamond honing stones, garnet honing stones or other like materials. Different compositions remove material at different rates and produce different surface finishes.

In operation, the exaggerated taper shown in FIG. 2 is reduced by the following procedure. The control signals received from comparator 74 are sent to fluid compressor 54 which activates and brings either backup shoe 18 or 20 or both down into compressive contact with journal bearing surface 14 depending upon the amount and direction of taper existing on the workpiece. FIG. 2 shows an exaggerated taper existing on the bearing journal surface with the high side of the taper below backup shoe 18 and the low side below backup shoe 20. If a taper exists on the journal bearing surface as shown in FIG. 2, backup shoe 18 and 20 are brought down simultaneously at pressures corresponding to signals received from the comparator. These signals will force backup shoes 18 and 20 down into compressive contact with an abrading means for removing material on the bearing journal surface. This variable pressure will continue until the amount of material removed from the surface brings the differences between diameters $D_1$ and $D_2$ below predetermined constant $V_o$.

FIG. 4 shows seven taper correction microfinishing arm assemblies used in conjunction with a means for rotating a workpiece about a longitudinal axis. The means for rotating, head stock 76 and tail stock 78 is shown in FIG. 4. The microfinishing machine of the present invention can be configured to accommodate as many microfinishing arm assemblies as needed for each individual journal bearing surface included on a workpiece.

FIG. 4 shows a crankshaft having seven journal surfaces and seven corresponding taper correction arm assemblies. Four taper correction microfinishing arm assemblies 82, 84, 86, 88 are disposed adjacent four main bearing journal surfaces 90, 92, 94, 96. Three taper correction microfinishing arm assemblies 98, 100, 102 are disposed adjacent three pin bearing journal surfaces 104, 106, 108. Machine base 80 is used to mount head stock 76, tail stock 78 and microfinishing arm assemblies according to the present invention. The workpiece, in this example a crankshaft, can be rotated by various methods such as power roller or between centers as shown in FIG. 4.

While the above description constitutes the preferred embodiments of the present invention, it will be appreciated that the invention is susceptible of modification, variation and change without departing from the proper scope and fair meaning of the accompanying claims.

What is claimed is:

1. A microfinishing arm assembly for reducing taper on selected bearing journal surfaces of a workpiece which is rotated about a longitudinal axis, past predetermined locations comprising:

a primary finishing arm;

taper correction means for applying a plurality of adjacent, independently variable grinding pressures to said journal surfaces at said predetermined locations, said taper correction means mounted on said primary finishing arm;

primary abrasive means for finishing said journal surfaces, said abrasive means mounted on said primary finishing arm and adapted for use in cooperation with said taper correction means;

measuring means for gauging said bearing journal surfaces at a plurality of spaced points thereon during rotation of said workpiece to generate a plurality of gauging signals, processor means in electrical contact with said measuring means for receiving said gauging signals, calculating the diameters of said journal surfaces at said spaced points and generating a plurality of output signals corresponding to the diameters of said journal surfaces at said spaced points;

comparator means in electrical contact with said processor means for comparing said output signals to determine the taper on said selected journal surfaces and controlling the extent to which said taper correction means applies variable grinding pressure to said selected surfaces to correct said taper.

2. A microfinishing arm assembly as in claim 1, wherein said taper correction means comprises a plurality of backup shoes affixable to said finishing arm and actuating means for applying variable pressure to said backup shoes.

3. A microfinishing arm assembly as in claim 2, wherein said actuating means comprises:

a cylindrical bore located within said finishing arm, a reciprocating piston disposed within said cylindrical bore, a fluid inlet disposed within said primary finishing arm and variable pressurizing means adapted for use in cooperation with said primary finishing arm, wherein said bore, piston and fluid inlet are each in fluid communication with said variable pressure means for inducing a pressurized fluid into said fluid inlet to apply a variable pressure to said backup shoes.

4. A microfinishing arm assembly as in claim 3 wherein said variable pressuring means comprises a fluid compressor.

5. A microfinishing arm assembly according to claim 1 wherein said abrasive means comprises an abrasive insert affixable to said backup shoe.

6. A microfinishing arm assembly according to claim 1 wherein said abrasive means comprises an abrasive coated tape.

7. A microfinishing arm assembly as in claim 1 wherein said measuring means comprises a first pair of gauges positioned at diametrically opposite locations adjacent said selected journal surfaces and a second pair of gauges positioned at diametrically opposite locations adjacent said selected journal surfaces, said first and second pairs of gauges selectively spaced apart from each other and disposed in a plane perpendicular to said longitudinal axis of rotation.

8. A microfinishing arm assembly as in claim 7 wherein said first and second pair of gauges are air jet gauges.

9. A microfinishing arm assembly as in claim 7 wherein said first and second pair of gauges are optical gauges.

10. A microfinishing arm assembly as in claim 7 wherein said first and second pair of gauges are electromechanical gauges.

11. A microfinishing arm assembly as in claim 1, further comprising:

a secondary finishing arm including a unitary backup shoe adapted to be located below and directly opposite said primary finishing arm; and secondary abrasive means for finishing said journal surfaces, said secondary abrasive means mountable on said secondary finishing arm and adapted for use in cooperation with said taper correction means.

12. A microfinishing arm assembly as in claim 11 wherein said secondary abrasive means comprises an abrasive insert affixable to said unitary backup shoe.

13. A microfinishing arm assembly as in claim 12 wherein said secondary abrasive means comprises an abrasive coated tape.

14. A microfinishing machine for reducing taper on selected bearing journal surfaces comprising:

a machine base;

a primary finishing arm affixable to said base;

rotating means for rotating said workpiece about a longitudinal axis thereby causing said journal surfaces to rotate past predetermined locations, said rotating means affixable to said base;

taper correction means for applying a plurality of adjacent, independently variable grinding pressures to said journal surfaces at said predetermined locations, said taper correction means mounted on said primary finishing arm;

primary abrasive means for finishing said journal surfaces, said abrasive means mounted on said primary finishing arm and adapted for use in cooperation with said taper correction means;

measuring means for gauging said bearing journal surfaces at a plurality of spaced points thereon during rotation of said workpiece to generate a plurality of gauging signals, processor means in electrical contact with said measuring means for receiving said gauging signals, calculating the diameters of said journal surfaces at said spaced points and generating a plurality of output signals corresponding to the diameters of said journal surfaces at said spaced points;

comparator means in electrical contact with said processor means for comparing said output signals to determine the taper on said selected journal surf aces and controlling the extent to which said taper correction means applies variable grinding pressure to said selected surfaces to correct said taper.

15. A microfinishing machine as in claim 14 wherein said taper correction means comprises a plurality of backup shoes affixable to said finishing arm and actuating means for applying variable pressure to said backup shoes.

16. A microfinishing machine as in claim 15 wherein said actuating means comprises:

a cylindrical bore located within said finishing arm, a reciprocating piston disposed within said cylindrical bore, a fluid inlet disposed within said primary finishing arm and variable pressurizing means adapted for use in cooperation with said primary finishing arm, wherein said bore, piston and fluid inlet are each in fluid communication with said variable pressure means for inducing a pressurized fluid into said fluid inlet to apply a variable pressure to said backup shoes.

17. A microfinishing machine as in claim 16 wherein said variable pressuring means comprises a fluid compressor.

18. A microfinishing machine as in claim 14 wherein said abrasive means comprises an abrasive insert affixable to said backup shoe.

19. A microfinishing machine according to claim 14 wherein said abrasive means comprises an abrasive coated tape.

20. A microfinishing machine as in claim 14 wherein said measuring means comprises a first pair of gauges positioned at diametrically opposite locations adjacent said selected journal surfaces and a second pair of gauges positioned at diametrically opposite locations adjacent said selected journal surfaces, said first and second pairs of gauges selectively spaced apart from each other and disposed in a plane perpendicular to said longitudinal axis of rotation.

21. A microfinishing machine as in claim 20 wherein said first and second pair of gauges are air jet gauges.

22. A microfinishing machine as in claim 20 wherein said first and second pair of gauges are optical gauges.

23. A microfinishing machine as in claim 20 wherein said first and second pair of gauges are electromechanical gauges.

24. A microfinishing machine as in claim 14 further comprising:

a secondary finishing arm including a unitary backup shoe adapted to be located below and directly opposite said primary finishing arm; and a secondary abrasive means for finishing said journal surfaces, said secondary abrasive means mountable on said secondary finishing arm and adapted for use in cooperation with said taper correction means.

25. A microfinishing machine as in claim 24 wherein said secondary abrasive means comprises an abrasive insert affixable to said unitary backup shoe.

26. A microfinishing machine as in claim 24 wherein said secondary abrasive means comprises an abrasive coated tape.

27. A method of reducing taper on selected bearing journal surfaces of a workpiece which is rotated about a longitudinal axis past predetermined locations, comprising:

providing a finishing arm having abrasive means mounted thereon for finishing selected journal bearing surfaces;

providing a measuring means mounted on said finishing arm;

measuring said selected journal bearing surfaces at a plurality of spaced points thereon during rotation of said workpiece;

generating a plurality of gauging signals in accordance with said journal bearing surface measurements;

analyzing said gauging signals and calculating the diameters of said selected journal surfaces at said spaced points;

generating a plurality of output signals corresponding to the diameters of said selected journal surfaces at said spaced points;

providing comparator means for comparing said output signals to determine the taper on said selected journal surfaces and generating corresponding control signals;

providing taper correction means in electrical contact with said comparator means for receiving said control signals, said taper correction means mountable on said primary finishing arm;

applying variable grinding pressure to said selected journal surfaces in accordance with said control signal to correct said taper.

* * * * *